US006004141A

United States Patent [19]

Abe et al.

[11] Patent Number: 6,004,141

[45] Date of Patent: Dec. 21, 1999

[54] SOCKET FOR ELECTRONIC PART

[75] Inventors: Hiroshi Abe; Naoki Hiyama, both of Yokohama, Japan

[73] Assignee: Otax Co., Ltd., Japan

[21] Appl. No.: 09/109,073

[22] Filed: Jul. 2, 1998

[30] Foreign Application Priority Data

Dec. 12, 1997 [JP] Japan ..... 9-342545

[51] Int. Cl.[6] ..... H01R 9/09

[52] U.S. Cl. ..... 439/73; 439/331; 439/342

[58] Field of Search ..... 439/73, 71, 331, 439/66, 342

[56] References Cited

U.S. PATENT DOCUMENTS 5,221,209 6/1993 D'Amico ..... 439/71

5,395,254 3/1995 Mogi ..... 439/71

5,419,710 5/1995 Pfaff ..... 439/71

5,518,410 5/1996 Masami ..... 439/71

*Primary Examiner*—Khiem Nguyen

*Assistant Examiner*—T C Patel

*Attorney, Agent, or Firm*—Lorusso & Loud

[57] ABSTRACT

There is disclosed a socket for use with an electronic part, which is simple in structure and easily fabricated and in which a reliable contact between electrode terminals of the electronic part and those of a socket body is obtained when the electronic part is mounted or detached. Each electrode portion 1*b* of a socket body 10*b* has a sliding contact which contacts with an electrode terminal of the electronic part and whose contact point is movable by pushing of the electronic part against the socket body in a direction B perpendicular to the push, and a spring contact which biases with its degree of contact with the sliding contact increasing in proportion to a movable amount of the sliding contact.

12 Claims, 6 Drawing Sheets

FIG. 2(a)
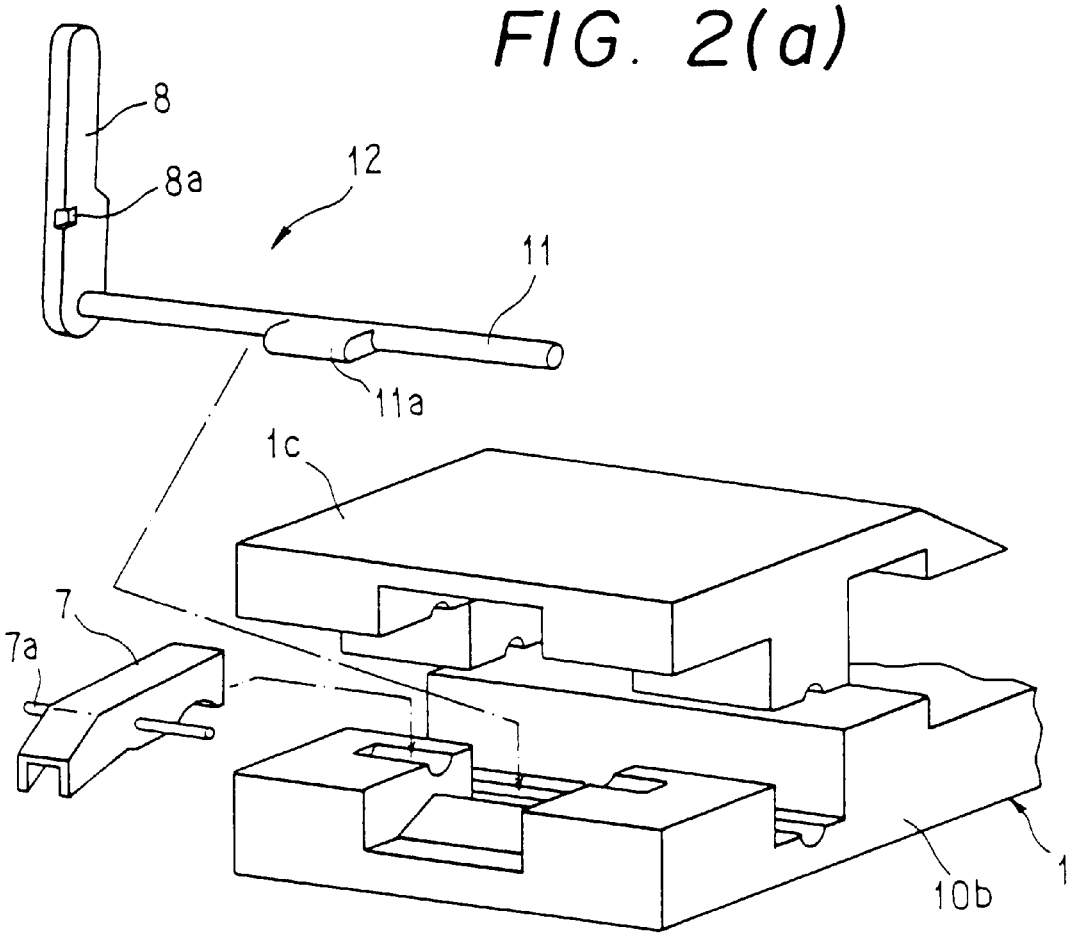
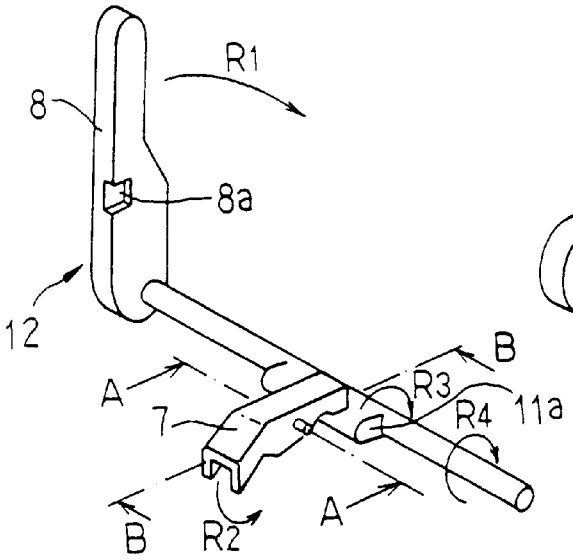
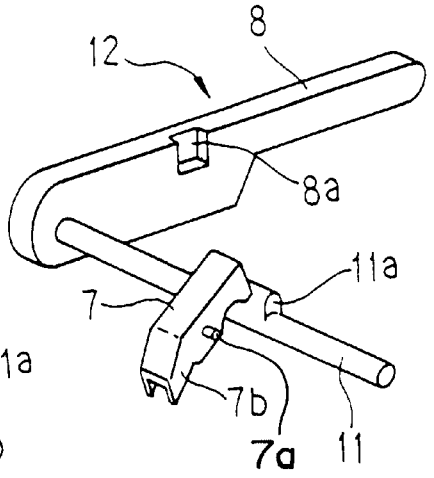
FIG. 2(b) FIG. 2(c)

SOCKET FOR ELECTRONIC PART

BACKGROUND OF THE INVENTION

The present invention relates to a socket for an electronic part and, more particularly, to a socket adapted designed so that an electronic part such as a CPU or an MPU is pushed into and received in a socket body to maintain contact of the electrode terminals of the electronic part with the electrode portions of the socket body.

In recent years, electronic part having a large number of electrode terminals such as a CPU or an MPU has been equipped with pin-grid array electrode terminals or cheaper electrode terminals such as ball-grid array electrode terminals and land-grid array electrode terminals. A socket for use with such an electronic part having these electrode terminals is used to mount this electronic part on a printed wiring board and to make electrical connection of the electrode terminals of the electronic part with the circuit of the printed wiring board.

A known socket of this kind for an electronic part has a socket body into which the electronic part is pushed, for maintaining connection of the electrode terminals of the electronic part with the electrode terminals of the socket body. Further concretely, the socket body has one end portion coupled to one end portion of a push member with a hinge member. The push member is swung about the coupled position. After the push member has been urged into the socket body side, a hook which acts as a latch mechanism capable of opening and closing and is mounted to the other end of the push member is engaged on an engaging portion of the socket body. Thus, the electronic part is fixedly mounted to the socket body. The contact of the electrode terminals of the electronic part with the electrode terminals of the socket body is maintained. The use of this kind of socket for the electronic part has a merit in that it facilitates attaching and detaching of the electronic part and its maintenance or the like, unlike the case where electrode terminals are soldered together by a reflow or the like.

The individual electrodes of the electronic part and of the socket body differ from each other due to their materials and fabrication processes. Further, in the electronic part having plural electrode terminals and in the socket body, the surface holding the electrode terminals has a certain area. Therefore, there is the possibility that the load of the push member forced against the socket body is imposed nonuniformly among the plural electrode terminals. These differences and nonuniform application of the load would normally induce poor contact of the electronic part with the socket body. To prevent this, a socket is used which renders movable a terminal member which makes contact with the electrode terminals of the electronic part.

However, it has been found that this socket for an electronic part cannot readily satisfy the following two requirements (1) and (2) simultaneously: (1) when the socket is placed in position, the movable contact member reliably makes contact with a support member, and (2) the movable contact member easily returns to a protruding position. Furthermore, it has been found that this socket becomes complex in structure.

SUMMARY OF THE INVENTION

In view of the foregoing, the present invention has been made.

It is an object of the present invention to provide a socket for an electronic part, which is adapted so as to prevent the contact of the electrode terminals of the electronic part with the electrode portions of the socket body from deteriorating as the electronic part is repeatedly attached and detached, and which is relatively simple in structure.

According to the present invention, in order to achieve this object, there is provided a socket for use with an electronic part in which by pushing the electronic part against a socket body, contacts between electrode terminals of the electronic part and electrode portions of the socket body are maintained and the electrode portions of the socket body are connected to electrode terminals of a printed wiring board, characterized in that each of the electrode portions of the socket body has a sliding contact which contacts with an electrode terminal of the electronic part and whose contact point is movable by the pushing in direction perpendicular to the push, and a spring contact which biases with its degree of contact with the sliding contact increasing in proportion to a movable amount of the sliding contact.

In the socket of the invention, the sliding contact has a wedgelike form which moves straight by the pushing, the spring contact is formed by a leaf spring, and they are disposed opposite each other in a groove of the socket body.

In another embodiment of the socket of the invention, the sliding contact has an arc-shaped form which rotatably moves by the pushing. The spring contact is formed by a leaf spring, and they are disposed opposite each other in a groove of the socket body.

Still further, in the socket of the invention, a groove of the socket body, in which the sliding contact and the spring contact are disposed opposite each other, is arranged in a matrix shape and diagonal manner.

BRIEF DESCRIPTION OF THE DRAWINGS

FIG. 2(*a*) is an exploded perspective view of a crank lever, a movable hook, and a socket;

FIG. 2(*b*) is a perspective view of the crank lever and the movable hook shown in FIG. 2(*a*), and in which an operation lever is not yet operated;

FIG. 2(*c*) is a view similar to FIG. 2(*b*), but in which the operation lever has been operated;

FIG. 4(*b*) is a view similar to FIG. 4(*a*), but illustrating the operation after contact with the electrode portions;

FIG. 4(*c*) is a view illustrating the arrangement of the sliding contacts and the spring contacts of the electrode portion shown in FIGS. 4(*a*) and 4(*b*);

FIG. 5(*b*) is a view similar to FIG. 5(*a*), but illustrating the operation after contact of the electrode portions;

FIG. 5(*c*) is a view illustrating the arrangement of the sliding contacts and the spring contacts of the electrode portions shown in FIGS. 5(*a*) and 5(*b*);

FIG. 6(*b*) is a view similar to FIG. 6(*a*), but in which the electrode portion has made contact;

FIG. 7(*b*) is a view similar to FIG. 7(*a*), but in which the electrode portion has made contact.

DESCRIPTION OF THE PREFERRED EMBODIMENT

An embodiment of the invention in which the invention is applied to a CPU socket as a socket for an electronic part is hereinafter described with reference to the accompanying drawings. This CPU socket is used when mounting an electronic part as a CPU on a main board within a computer.

Figure 1:
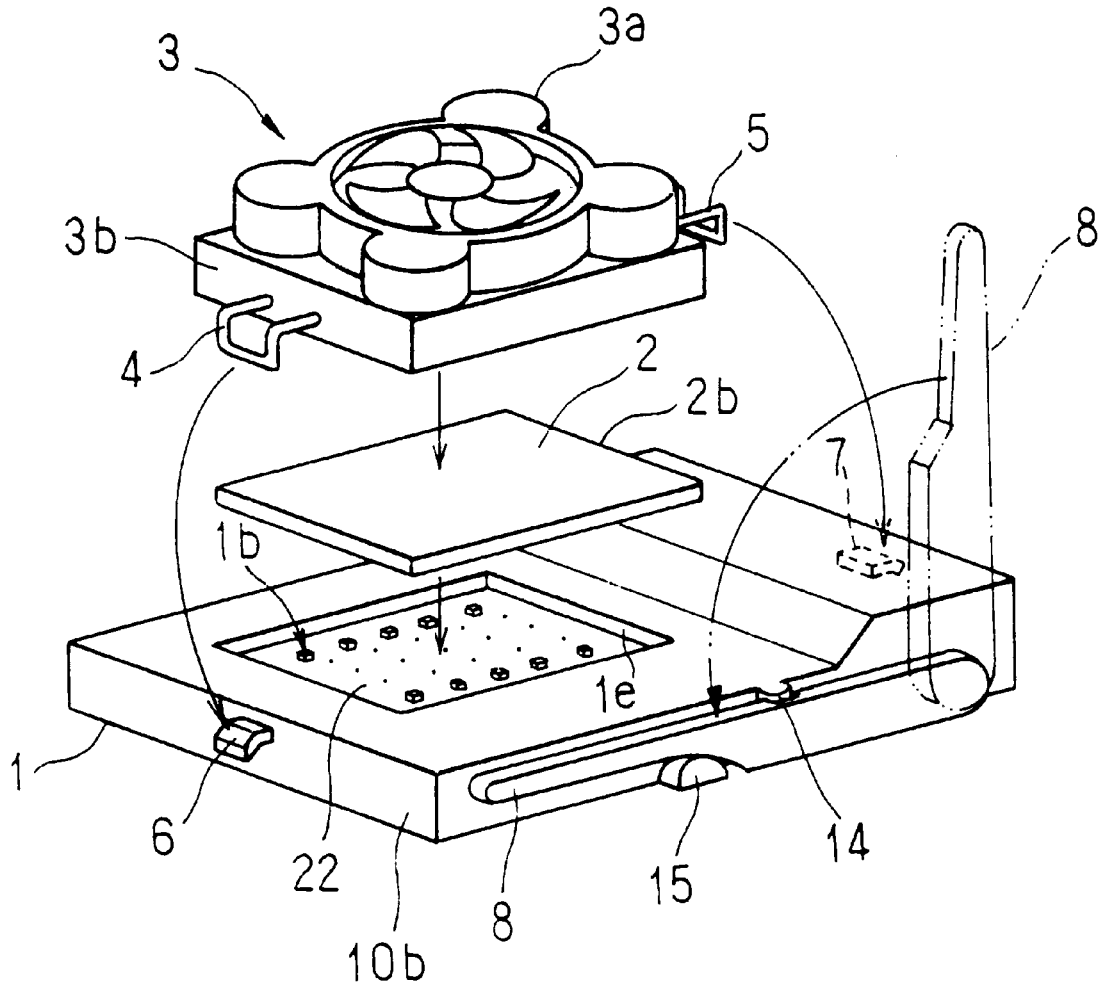
FIG. 1 is an exploded perspective view of a socket for use with an electronic part, a CPU, and a push member, the socket being built in accordance with the invention.

Firstly referring to FIG. 1, there is shown a socket 1 in accordance with the embodiment of the invention. A CPU 2 and a push member 3 are mounted onto the socket 1 in such a manner as described below.

Figure 3A:
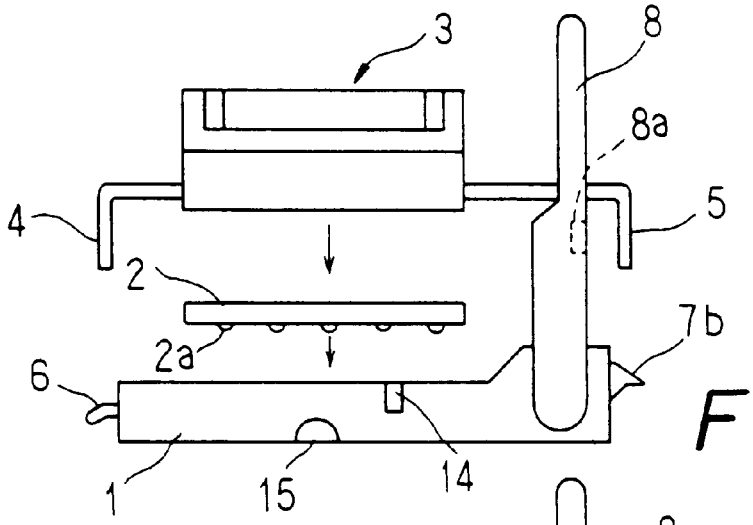
FIGS. 3(*a*)–3(*c*) are views illustrating the manner in which the CPU and the push member are mounted to the socket.
Figure 3B:
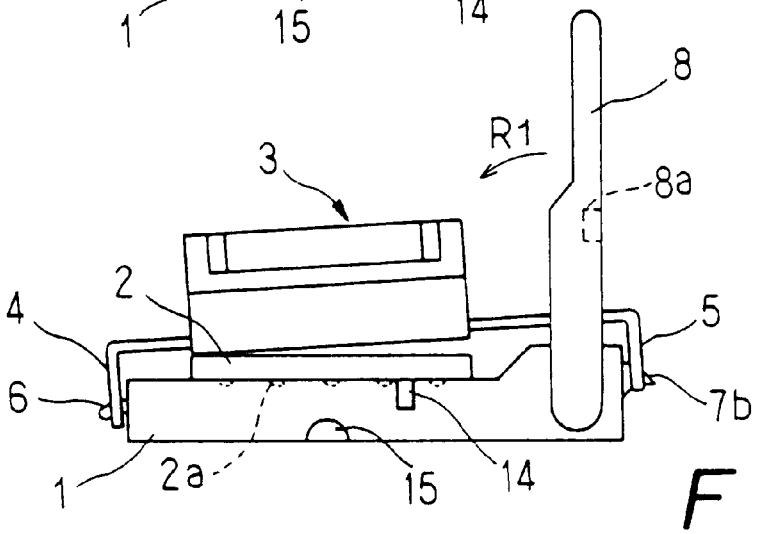
Figure 3C:
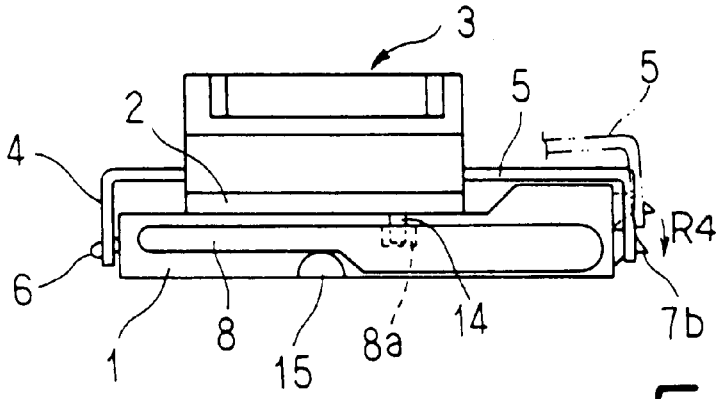

As shown in FIG. 1, an electronic part 2 has electrode portions 2*a* (see FIG. 3(*a*)). The socket 1 has electrode portions 1*b* with which the electrode terminals 2*a* of the electronic part 2 are brought into contact. The CPU 2 is first placed onto the top surface of the socket 1 guided by engagement between outer edges 2*b* of the CPU 2 and an inner side 1*e* of the socket body 10*b*. Next, the push member 3 is mounted from above the CPU 2. Anchoring wires 4 and 5 (for example, metal wires) are respectively mounted to two side surfaces of the push member 3. These anchoring wires 4 and 5 are respectively caught on a fixing hook 6 and a movable hook 7. The fixing hook 6 is mounted to one side surface of the socket 1. The movable hook 7 serves as a movable catching member. And, an operation lever 8 acts as an operation member. After the CPU 2 and the push member 3 have been placed on socket 1, if the operation lever 8 is turned into the position indicated by the solid line from the position indicated by the broken line, the movable hook 7 moves downward, thereby moving the push member 3 downward. This pushes the CPU 2 toward the socket 1 side. Incidentally, a drive mechanism for moving the movable hook 7 up and down will be described later.

Further, any push member may be applicable as long as a fixing member such as wires or the like can be mounted to it. For example, like an example shown in the drawing, if a cooling device comprising cooling fan 3*a* and heat-dissipating fins 3*b* is used as the push member, it has advantages in that a part which is exclusively a push member is not necessary and in that the cooling device indispensable for the CPU 2 can be surely mounted.

FIGS. 2(*a*)–2(*c*) illustrate the operation for mounting the CPU 2 and the push member 3 to the socket 1.

When they are not yet mounted as shown in FIG. 2(*a*), the front end of the movable hook 7 is located in its higher position. Under this condition, the front end of the anchoring wire 5 mounted on the push member 3 can be easily caught on the movable hook 7. And, as shown in FIG. 3(*b*), the CPU 2 and the push member 3 are placed on the socket 1, and the front end of the anchoring wire 4 on the push member 3 side is caught on the anchoring hook 6. The front end of the anchoring wire 5 is anchored to the front end portion 7*b* of the movable hook 7. Subsequently, the operation lever 8 is swung in the direction indicated by the arrow R1. And, as shown in FIG. 3(*c*), the operation lever 8 is swung until it bears against a stopper 15 formed on a side wall surface of the socket 1. A convex latch portion 14 formed on a side wall surface of the socket 1 is engaged in a notch portion 8*a* formed in a side wall surface of the operation lever 8 on the socket 1 side. Swinging movement of the operation lever 8 moves the front end 7*b* of the movable hook downward, i.e., in the direction indicated by the arrow R4. This urges the anchoring wire 5 downward, thereby pushing the CPU 2 against the socket 1 via the push member 3.

Incidentally, when the CPU 2 is removed from the socket 1, the operation lever 8 is so operated as to move away from the side surface of the socket 1. Consequently, the latch portion 14 of the socket 1 comes out of engagement with the notch 8*b* in the operation lever 8.

FIGS. 2(*a*)–2(*c*) illustrate the drive mechanism for moving the movable hook 7 up and down. As shown in FIG. 2(*a*), the main portion of this drive mechanism is constituted by a crank lever 12 (as a force booster) consisting of the operation lever 8 and a crankshaft portion 11, which are mutually connected so as to become nearly perpendicular. The crankshaft portion 11 of this crank lever 12 is rotatably mounted between the socket body 10*b* and a top cover member 1*c* at one end edge portion of the socket 1. Further, an eccentric shaft portion 11*a* is formed in the center of the crankshaft portion 11. As the crankshaft portion 11 rotates, an eccentric shaft portion 11*a* bears against one end of the movable hook 7 so as to push the movable hook 7 into its engaged position by which the CPU 2 is pulled toward the socket 1 side. Furthermore, the movable hook 7 is mounted between a socket body 10*b* and the top cover member 1*c* so as to be rotatable about a shaft member 7*a* attached penetrating through the side walls thereof.

In the drive mechanism constructed in this way, when the operation lever 8 is swung in the direction indicated by the arrow R1 as shown in FIG. 2(*b*), the crankshaft portion 11 rotates in the direction indicated by the arrow R4. Concomitantly, the eccentric shaft portion 11*a* in the center of the crankshaft portion 11 swings in the direction indicated by the arrow R3. By this swinging movement of the eccentric shaft portion 11*a*, the movable hook 7 whose one end is in abutment with the eccentric shaft portion 11*a* rotates about the shaft member 7*a* in the direction indicated by the arrow R2. As a result, as shown in FIG. 2(*c*), the front end portion 7*b* catches the wire 5 and moves it downward. Incidentally, a spring (not shown) acting as a biasing means for biasing the movable hook 7 into its release position is mounted to the shaft member 7*a* of the movable hook 7. In this release position, the pushing force of the push member decreases or ceases.

As mentioned previously, in the novel socket 1 for use with the electronic part 2, the contact of the electrode terminals 2*a* of the electronic part 2 with the electrode portions 1*b* of the socket body 10*b* is maintained by pushing the electronic part 2 against the socket body 10*b*. The electrode portions 1*b* of the socket body 10*b* are connected with the electrode terminals 17*a* of a printed wiring board 17 (FIGS. 4(*a*), 4(*b*), 5(*a*), and 5(*b*)). The electrode terminals 2*a* (FIGS. 3(*a*)–3(*c*)) of the electronic part 2 are ball-grid array electrode terminals or land-grid array electrode terminals.

Figure 4A:
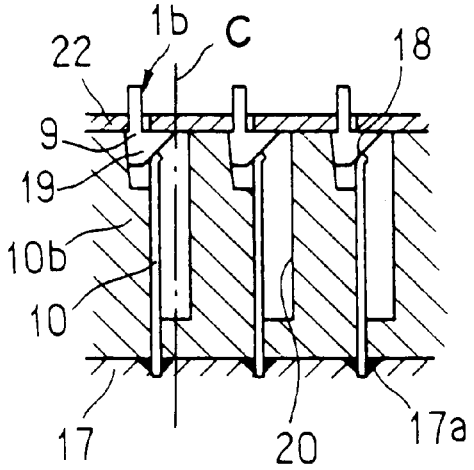
FIG. 4(*a*) is a cross-sectional view of the socket body in accordance with the invention, illustrating the operation before contact with the electrode portion of the socket body.
Figure 4B:
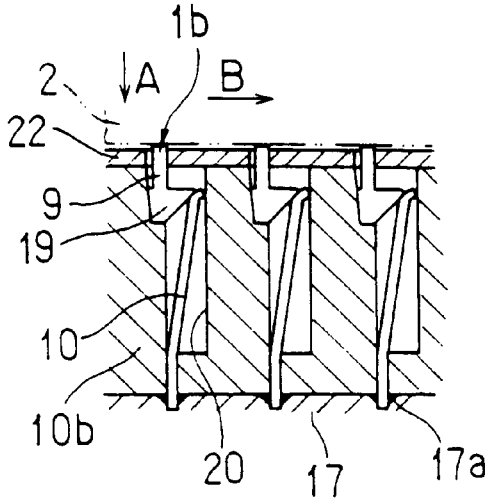
Figure 4C:
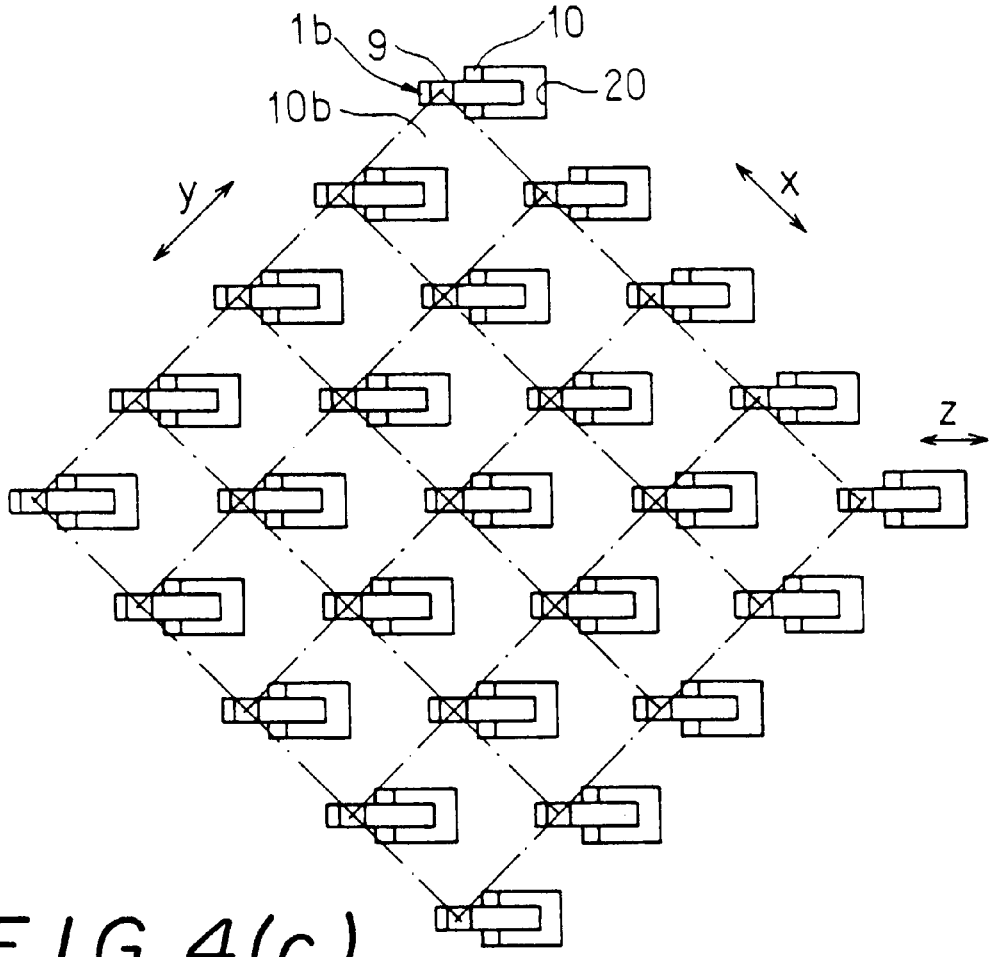

As shown in FIGS. 4(*a*), 4(*b*), 5(*a*), and 5(*b*), in the socket 1 for use with the electronic part, each electrode portion 1*b* of the socket body 10*b* comprises a sliding contact 9 and a spring contact 10 making resilient contact with the sliding contact 9. The sliding contacts 9 make contact with their respective electrode terminals 2*a*. When the electronic part 2 is pushed against the socket body 10*b*, a contact point 18 (FIG. 4*a*) of the sliding contact 9 can move in a direction (indicated by the arrow B) perpendicular to the direction of the push (indicated by the arrow A). The degree of intimateness of the contact of the spring contact 10 with the sliding contact 9 increases in proportion to the amount of movement of the sliding contact 9.

As shown in FIGS. 4(*a*), 4(*b*), 6(*a*), and 6(*b*), in the sliding contact 9 of the novel socket for use with the electronic part, the sliding contact 9 has a wedgelike form 19 moving straight as the electronic part 2 is pushed against the socket body 10*b*. The spring contact 10 is made of a leaf spring and located opposite to the sliding contact 9 in a groove or recess 20 of the socket body 10*b*. The groove or recess 20 defines a central axis C. A protective cover 22 has holes through which the sliding contacts 9 pass. The cover 22 is mounted on the socket body 10*b* (FIG. 1).

In the socket constructed in this way, when the electronic part 2 is pushed against the socket body 10*b* in the direction indicated by the arrow A by the push member 3 (FIGS. 4(*b*) and 6(*b*)), the electrode terminals 2*a* of the electronic part 2 come into contact with their respective sliding contacts 9 of the electrode portions 1*b* of the socket body 10*b*, and the sliding contacts 9 move straight inside the grooves 20. Because of their wedgelike form 19, the contact points 18 move in the direction (indicated by the arrow B) perpendicular to the direction of the push (indicated by the arrow A). The spring contacts 10 make resilient contact with the sliding contacts 9 with the degree of intimateness increasing in proportion to the amount of movement of the sliding contacts 9. The protective cover 22 permits only the electrode terminals 2*a* of the electronic part 2 to contact the sliding contacts 9 under a given pressure and prevents further movement of the electronic part 2.

Figure 5A:
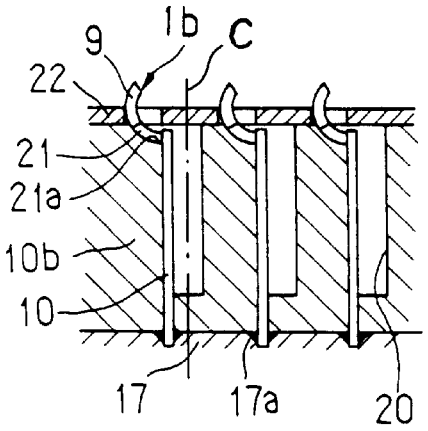
FIG. 5(*a*) is a cross-sectional view of another socket in accordance with the invention, illustrating the operation before contact of the electrode portions of the socket body.
Figure 5B:
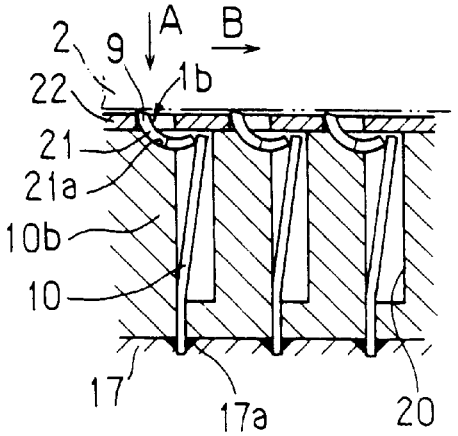
Figure 5C:
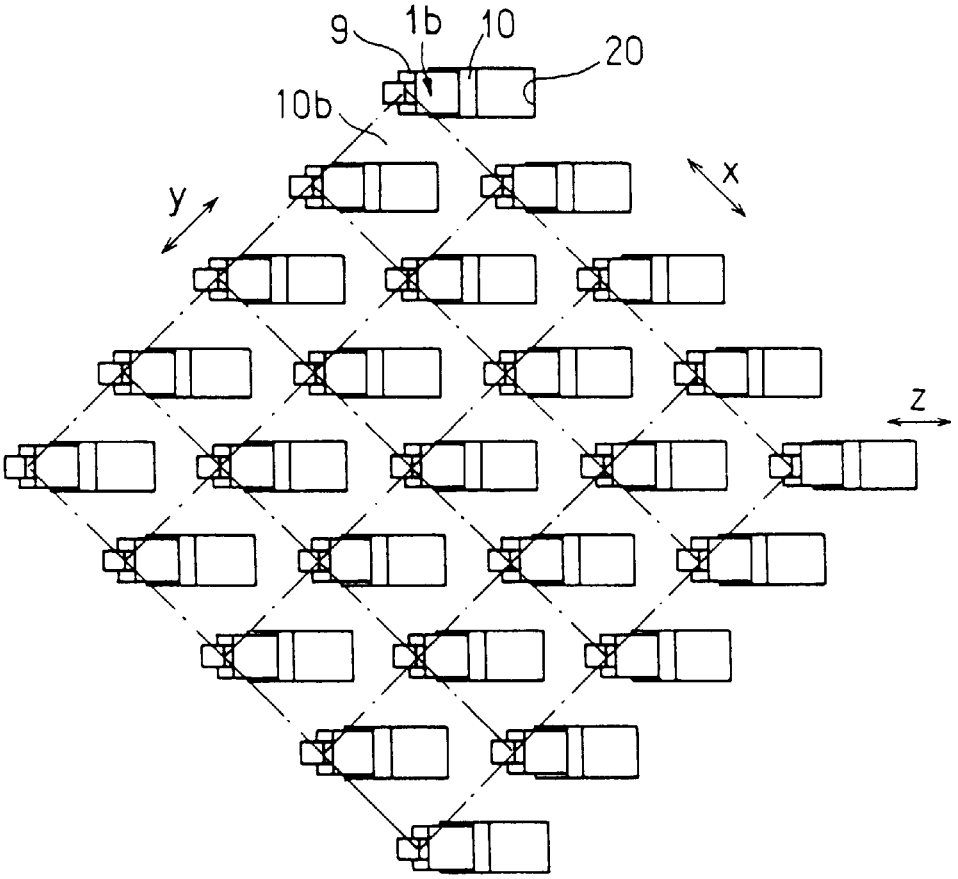
Figure 6A:
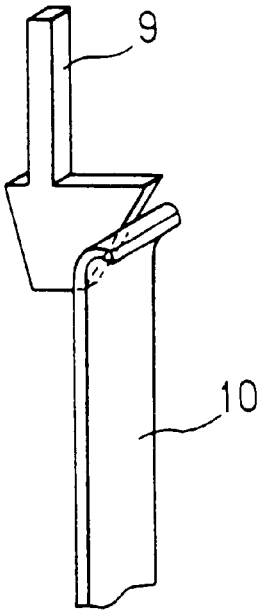
FIG. 6(*a*) is a perspective view of one electrode portion of a further socket in accordance with the invention, and in which the electrode portion does not yet make contact.
Figure 6B:
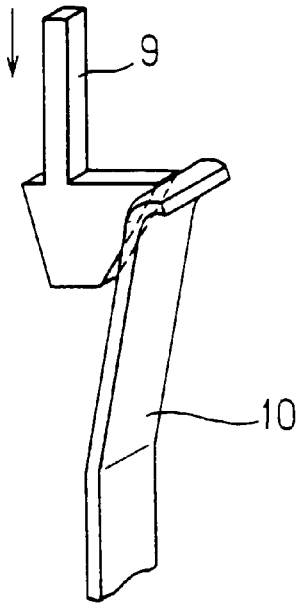
Figure 7A:
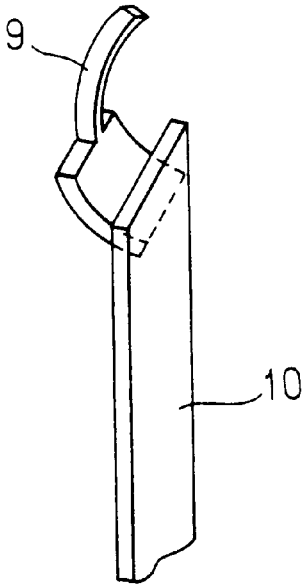
FIG. 7(*a*) is a perspective view of one electrode portion of a yet other socket in accordance with the invention, and in which the electrode portion does not yet make contact.
Figure 7B:
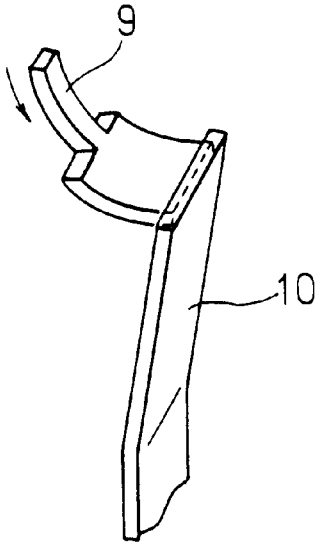

As shown in FIGS. 5(*a*), 5(*b*), 7(*a*), and 7(*b*), in the novel socket for use with the electronic part, each sliding contact 9 has an arc-shaped form 21 which rotates as the electronic part 2 is pushed toward the socket body 10*b*. The spring contact 10 is formed by a leaf spring positioned opposite to the sliding contact 9 in a groove 20 formed in the socket body 10*b*. Arc-shaped guide portions 21*a* are formed in the grooves 20 to guide the arc-shaped forms 21 of the sliding contacts 9.

In the novel socket constructed in this manner, when the push member 3 pushes the electronic part 2 against the socket body 10*b* in the direction of the push indicated by the arrow A (FIGS. 5(*b*) and 7(*b*)), electrode terminals 2*a* of the electronic part 2 come into contact with their respective sliding contacts 9 of the electrode portions 1*b* of the socket body 10*b*. The sliding contacts 9 rotate along the arc-shaped guide portions 21*a* inside the grooves 20 of the sliding contacts 9. Because of the arc-shaped form 21, their contact points 18 move in the direction (indicated by the arrow B) perpendicular to the direction of the push (indicated by the arrow A). The spring contacts 10 make resilient contact with their respective sliding contacts 9 with the degree of intimateness increasing in proportion to the amount of movement of the sliding contacts 9.

As shown in FIGS. 4(*c*) and 5(*c*), there are shown further sockets in accordance with the present invention. The body of each socket is indicated by numeral 10*b*. The socket body 10*b* is provided with a groove 20 in which a sliding contact 9 and a spring contact 10 are located opposite to each other. The grooves 20 of the socket body are arranged in a matrix consisting of rows and columns. The direction of the rows is indicated by x. The direction of the columns is indicated by y. The grooves 20 run in diagonal directions indicated by z. This diagonal arrangement provides good a space factor.

As can be understood from the description provided thus far, each electrode portion of the socket in accordance with the present invention comprises a sliding contact having a contact point and a spring contact making resilient contact with the sliding contact with the degree of intimateness increasing in proportion to the amount of movement of the sliding contact. The sliding contact makes contact with a corresponding one of the electrode terminals of an electronic part. When the electronic part is pushed, the contact point of the sliding contact can be moved perpendicular to the direction of the push. Therefore, when the electronic part is mounted or detached, poor contact of the electrode terminals of the electronic part with the electrode portions of the socket body is prevented. The socket is relatively simple in structure. Furthermore, it is easy to fabricate the socket.

In another socket built in accordance with the invention and used with an electronic part, sliding contacts and spring contacts are disposed in their respective grooves of the socket body, and these grooves run diagonally with respect to the directions of rows and columns. This diagonal arrangement offers good space factor.

In a further socket built in accordance with the invention and used with an electronic part, the sliding contacts and the spring contacts are simpler in structure than the prior art contacts. Therefore, where the electronic part is a CPU, the short path requirements (i.e., reductions in inductance and impedance) for increase of the clock frequency of the CPU (i.e., increase of the operating speed of personal computer) can be satisfied.

What is claimed is:

1. In a socket for use with an electronic part in which, by pushing the electronic part against a laterally extending surface of the socket, electrical contacts are established between electrode terminals of the electronic part and electrode portions of the socket and between the electrode portions of the socket and electrode terminals of a printed circuit board, and in which each electrode portion of the socket is mounted within a recess in the socket opening at the laterally extending surface and in which each electrode portion of the socket includes a spring contact and a sliding contact which contacts the spring contact, at a contact point, to connect an electrode terminal of the electronic part with the spring contact and, through the spring contact, an electrode terminal of the printed circuit board;

the improvement wherein said sliding contact has a triangular wedge-like form which moves axially in parallel with a central axis defined by said recess, responsive to said pushing, wherein said spring contact is formed by a leaf spring, wherein the contact point between the sliding contact and the spring contact moves along a flat contact surface of the sliding contact which is slanted relative to the central axis, responsive to said pushing, and wherein the leaf spring is biased against the sliding contact with a force which increases in proportion to the extent of movement of said sliding contact caused by said pushing.

2. A socket according to claim 1 wherein said sliding contact has a sliding surface laterally opposite said contact surface, said sliding surface sliding along a wall surface of said recess, responsive to the pushing.

3. In a socket for use with an electronic part in which, by pushing the electronic part against a laterally extending surface of the socket, electrical contacts are established between electrode terminals of the electronic part and electrode portions of the socket and between the electrode portions of the socket and electrode terminals of a printed circuit board, and in which each electrode portion of the socket is mounted within a recess in the socket opening at the laterally extending surface and in which each electrode portion of the socket includes a spring contact and a sliding contact which contacts the spring contact, at a contact point, to connect an electrode terminal of the electronic part with the spring contact and, through the spring contact, an electrode terminal of the printed circuit board;

the improvement wherein said sliding contact is an arc-shaped member wherein said spring contact is formed by a leaf spring, wherein one end of the arc-shaped member bears against a free end of said leaf spring to displace said free end laterally within said recess, responsive to said pushing and wherein the leaf spring is biased against the sliding contact with a force which increases in proportion to the extent of movement of said sliding contact caused by said pushing.

4. A socket for connecting electrode terminals of an electronic part to electrode terminals of a printed circuit board, said socket comprising:

a plurality of recesses, each recess extending along a central axis between a bottom and an opening at a lateral surface of the socket;

a leaf spring electrical contact mounted within each of said recesses and extending from a fixed end, for contact with a terminal of the printed circuit board, to a free end adjacent said opening, said fixed end being anchored at one side of said recess and within a portion of said socket adjacent said bottom;

a sliding electrical contact mounted within each of said recesses, said sliding electrical contact protruding from the opening of the recess in which it is mounted for contact with an electrode terminal of the electronic part, said sliding electrical contact displacing said free end of said leaf spring from a first position at said one side of said recess in a direction perpendicular to and initially toward said central axis, as said sliding electrical contact is moved by contact with an electrode terminal of the electronic part.

5. A socket according to claim 4 wherein said sliding electrical contact has a wedge shape presenting a contact surface slanted with respect to said central axis, said free end of said leaf spring electrical contact sliding on said contact surface between a first contact point where said sliding electrical contact is free from contact with an electrode terminal of the electronic part and a second contact point where said electronic part is fully seated within said socket.

6. A socket according to claim 5 wherein said contact surface is straight and flat between said first and second contact points.

7. A socket according to claim 5 wherein said sliding electrical contact is forced deeper within said recess by contact with a terminal of the electronic part and, as said sliding electrical contact is forced deeper within said recess, said leaf spring is moved from the first position adjacent said one side and corresponding to said first contact point, initially toward said central axis, and across said central axis to a second position adjacent a side of the recess opposite said one side and corresponding to said second contact point.

8. A socket according to claim 4 wherein said leaf spring lies flush against and extends axially along said one side in said first position.

9. A socket according to claim 4 wherein said sliding electrical contact is an arcuate member mounted within an arcuate groove formed in said socket for rocking motion relative to said groove.

10. A socket according to claim 9 wherein as the arcuate member is rocked by contact with a terminal of the electronic part, the free end of said leaf spring is moved from the first position adjacent said one side, initially toward said central axis, and across said central axis to a second position adjacent a side of the recess opposite said one side.

11. A socket according to claim 9 wherein said leaf spring lies flush against and extends axially along said one side in said first position.

12. A socket according to claim 4 wherein said sliding contact has a wedge shape presenting a contact surface slanted with respect to the central axis and on which said free end of said leaf spring electrical contact moves and, opposite said contact surface, a sliding surface which slides along a wall surface of said recess responsive to the pushing.

* * * * *